US006722715B1

(12) United States Patent
Chiang

(10) Patent No.: US 6,722,715 B1
(45) Date of Patent: Apr. 20, 2004

(54) MAGNETIC SWING DOOR LOCK

(76) Inventor: Fanny Chiang, 11 Fl.-4, No. 16, Chungming S. Rd., West Dist., Taichung (TW)

( * ) Notice: Subject to any disclaimer, the term of this patent is extended or adjusted under 35 U.S.C. 154(b) by 0 days.

(21) Appl. No.: 10/401,991

(22) Filed: Mar. 31, 2003

(51) Int. Cl.[7] ..... E05C 17/56
(52) U.S. Cl. ..... 292/251.5; 292/DIG. 62
(58) Field of Search ..... 292/251.5, 341.16, 292/DIG. 62

(56) References Cited

U.S. PATENT DOCUMENTS 4,487,439 A * 12/1984 McFadden ..... 292/251.5
4,840,411 A * 6/1989 Sowersby ..... 292/251.5
4,981,312 A * 1/1991 Frolov ..... 292/251.5
5,016,929 A * 5/1991 Frolov ..... 292/251.5
5,076,623 A * 12/1991 Richards ..... 292/251.5
6,007,119 A * 12/1999 Roth et al. ..... 292/251.5
6,053,546 A * 4/2000 Frolov ..... 292/251.5
6,135,515 A * 10/2000 Roth et al. ..... 292/251.5
6,260,892 B1 * 7/2001 Chang ..... 292/251.5

* cited by examiner

*Primary Examiner*—Gary Estremsky
(74) *Attorney, Agent, or Firm*—Rosenberg, Klein & Lee

(57) ABSTRACT

A magnetic lock includes a first metal block securely received in the first frame, and an electrical magnet adapted to connect to a power source to selectively become a magnet and a second frame adapted to be mounted on a door and provided with a second metal block movable respect to the first metal block and the second frame. The second metal block has two retaining recesses to respectively receive therein two clamping blocks. Each of the two clamping blocks is adapted to be movably received in the two retaining recesses and has a recess to receive therein one of the two bolts. When the second metal block is moved by an external force, an inner side face of the recess of each of the clamping blocks abuts a side face of each of the bolts so that the door is still secured to the doorframe.

11 Claims, 10 Drawing Sheets

MAGNETIC SWING DOOR LOCK

BACKGROUND OF THE INVENTION

1. Field of the Invention

The present invention relates to a magnetic lock, and more particularly to a magnetic swing door lock having a pair of bolts adapted to be securely mounted on a doorframe and a metal block movably mounted on a door and having two clamping blocks movably mounted on the metal block and each provided with a retaining recess defined to correspond to one of the pair of bolts so that when the pair of bolts are received in the retaining recesses of the metal block, the abutment of the pair of bolts to side faces of the retaining recesses ensures the door will not be forced to open.

2. Description of Related Art

With reference to FIG. 7, a conventional magnetic lock is shown and has a first base (50) securely mounted on a doorframe (A) and a second base (60) securely mounted on a door (B).

With reference to FIG. 8, the first base (50) has a hollow frame (51) provided with a metal block (52) which is integrally formed inside the frame (51). An electrical magnet (53) is provided around the metal block (52) so that when electrical power is provided to the electrical magnet (53), a magnetic field is thus generated. Two holes (520) are defined in the metal block (52) to respectively allow the extension of two bolts (54). Each of the bolts (54) has a head (540) and the heads (540) protrude out of an outer face of the metal block (52).

The second base (60) has a second frame (61) and a second metal block (62) is movably received in the second frame (61). The second metal block (62) has two retaining recesses (620) defined to correspond to the two heads (540) in the first base (50).

With reference to FIG. 9, an extension hole (621) is defined through the second metal block (62) such that a retainer (63) is able to extend through the extension hole (621) to secure the second metal block (62) on the second base (60). A spring (64) is sandwiched between a bottom face defining the extension hole (621) and a head of the retainer so that the second metal block (62) is movable relative to the second base (60).

When the conventional magnetic lock is assembled, the two heads (540) correspond to the two retaining recesses (620).

With reference to FIGS. 10 and 11, when an electrical current is provided to the electrical magnet (53), the magnetic field attracts the second metal block (62) to move toward the metal block (52), which compresses the springs (64) and thus stores a recovery force for the second metal block (62). After the second metal block (62) moves upward to the metal block (52), the two heads (540) are respectively received in the retaining recesses (620). Referring to FIG. 7 and FIG. 8, the bolt (54) in the first frame (51) and away from the door frame (A) is designated with another reference (C) and the bolt (54) in the first frame (51) and close to the door frame (A) is designated with another reference (D).

Therefore, when the magnetic lock of this kind is activated and the heads (540) are respectively received in the retaining recesses (620), pushing the door (B) violently by a person who is not aware of the fact that the door (B) is actually locked by the magnetic lock will do serious damage to the bolt (D). That is, in order to successfully receive therein the heads (540), the dimension of the retaining recesses (620) is larger than that of the bolts (54). As a result, even after the heads (540) are received in the retaining recesses (620), there is still room left in the retaining recesses (620), which allows a person unaware of that the door (B) is actually locked to push the door (B). Because of the room left in the retaining recess (620), pushing the door (B) while the door (B) is locked will especially and seriously damage the bolt (D) instead of the bolt (C). Furthermore, with reference to FIG. 12, after the heads (540) are to be received in the retaining recesses (620), only one bolt (D) is securely received in the corresponding retaining recess (620) such that pushing the door (B) will cause the second metal block (62) to tilt and make the lock failed. Therefore, even when the door (B) is locked, an unauthorized personnel may still easily open the door (B). Besides, because there is only a single engagement between the retaining recess (620) and one of the heads (540), the engagement force is not enough to withstand the force trying to open the door and will thus cause rotation. Therefore, after a period of time repeatedly pushing the locked door (B) will definitely wear the side faces of the retaining recesses (620). As a consequence of pushing the locked door (B) violently, the conventional magnetic lock becomes useless and replacement is necessary. Further, a hexagonal countersunk hole normally is defined in each of the heads (540). However, due to the existence of the hexagonal countersunk hole in the heads (540), the strength of the bolt (54) is weak and thus is not rigid enough to withstand a long term use.

To overcome the shortcomings, the present invention tends to provide an improved magnetic lock to mitigate and obviate the aforementioned problems.

SUMMARY OF THE INVENTION

The primary objective of the present invention is to provide an improved magnetic lock having a pair of strengthened solid bolts and a pair of clamping blocks movable relative to the pair of bolts such that the magnetic lock is able to better withstand an external force exerted on the door trying to open the door when the door is locked to the doorframe.

In order to accomplish the foregoing objective, the magnetic lock of the present invention is provided with a pair of bolts adapted to be mounted on a doorframe and a metal block movably mounted on a door and having two clamping blocks movably mounted on the metal block and each clamping block provided with a retaining recess defined to correspond to one of the pair of bolts so that when the pair of bolts are received in the retaining recesses of the metal block, the abutment of the pair of bolts to side faces of the clamping blocks in the same time can hold metal block from tilting and ensures the door will not be forced to open.

Other objects, advantages and novel features of the invention will become more apparent from the following detailed description when taken in conjunction with the accompanying drawings.

DETAILED DESCRIPTION OF THE PREFERRED EMBODIMENT

Figure 1:
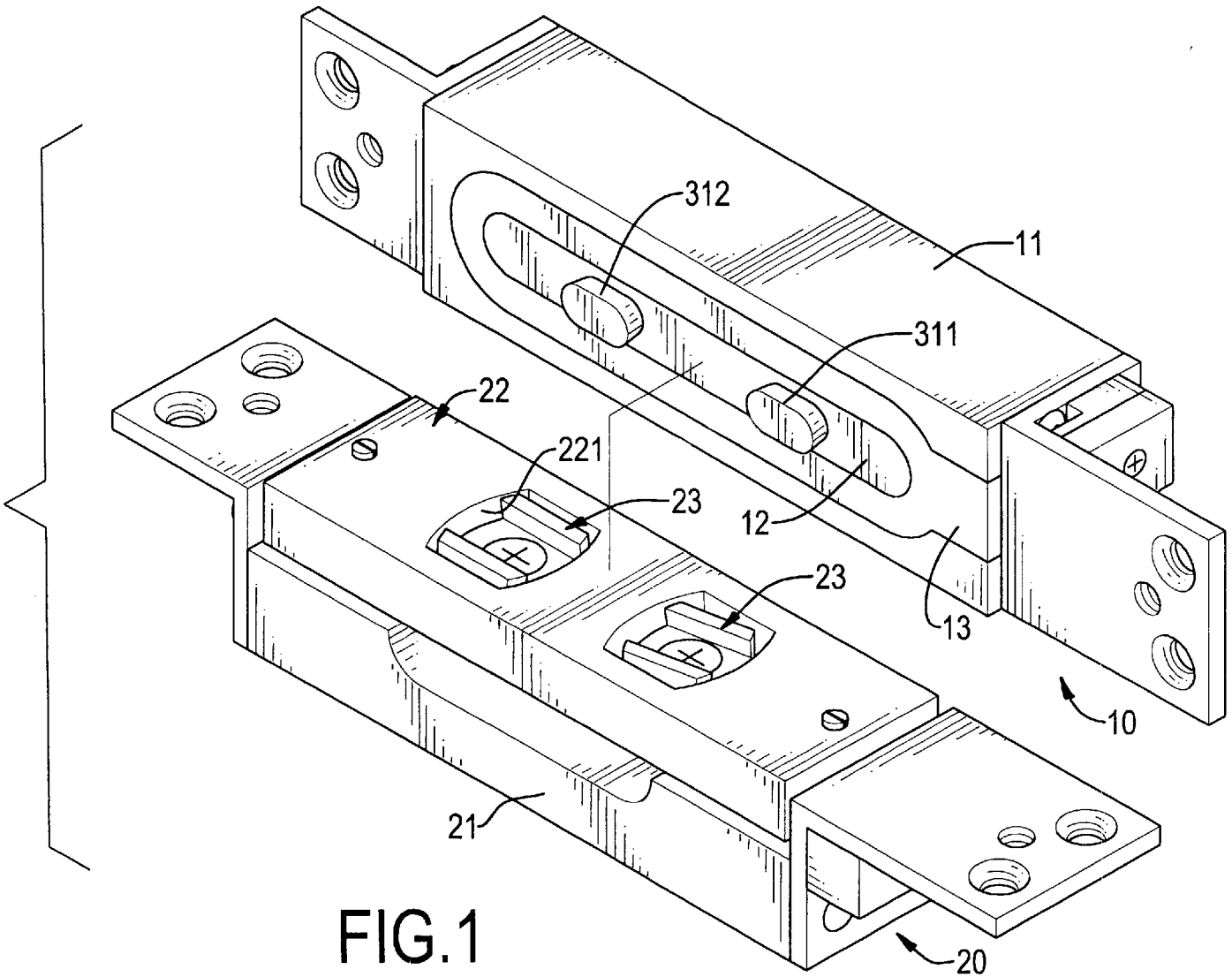
FIG. 1 is a perspective view of a first base and a second base of the magnetic lock of the present invention.
Figure 3:
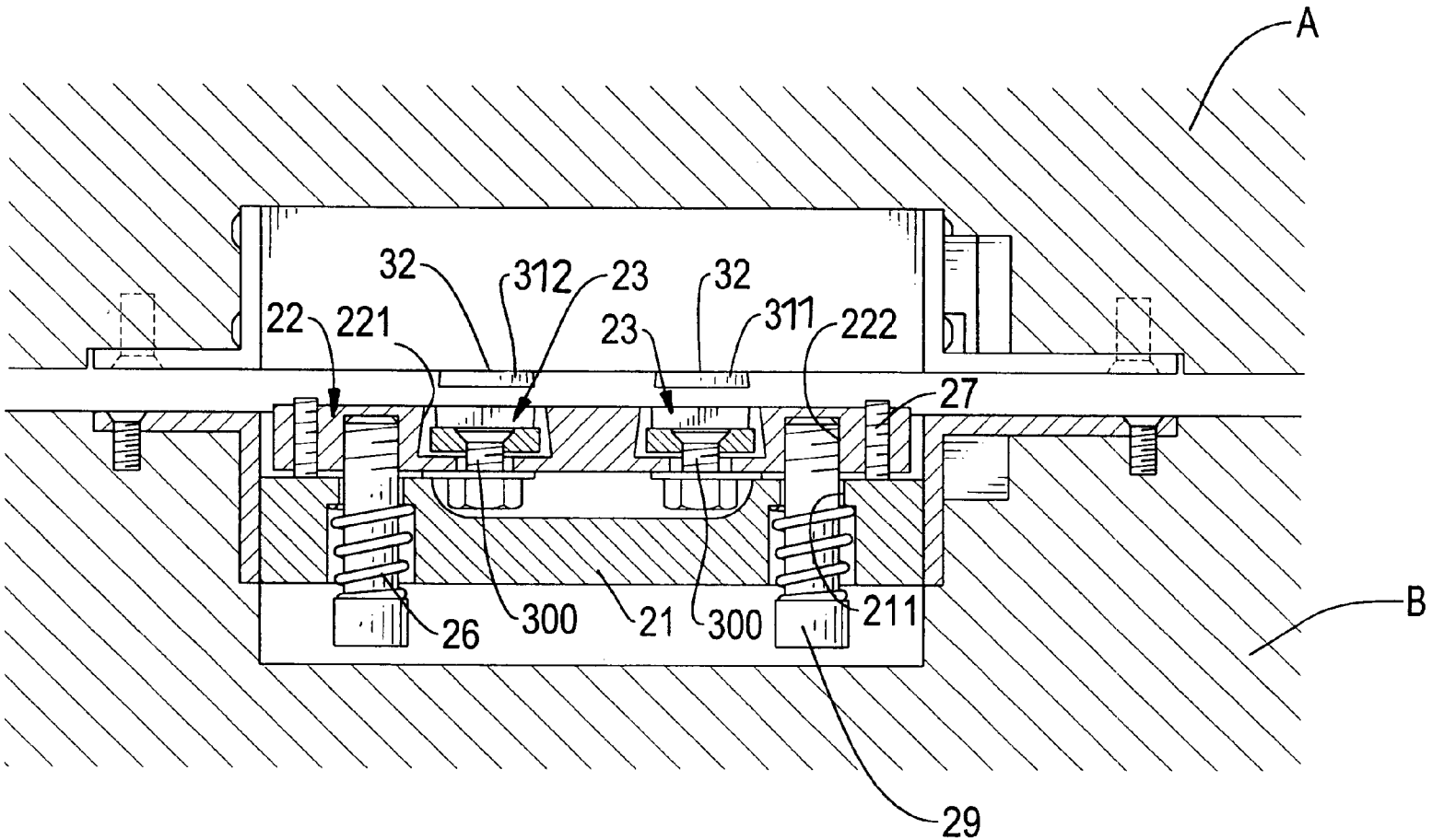
FIG. 3 is a partially cross sectioned side view of an assembled magnetic lock of the present invention.

With reference to FIG. 1, the magnetic lock in accordance with the present invention includes a first base (10) and a second base (20). The first base (10) is adapted to be mounted on a doorframe (A) (the reference mark for the doorframe is adapted to use the reference mark in the conventional magnetic lock and is shown in FIG. 3). The second base (20) is adapted to be mounted on a door (B) (the reference mark for the door is adapted to use the reference mark in the conventional magnetic lock and is shown in FIG. 3).

Figure 2:
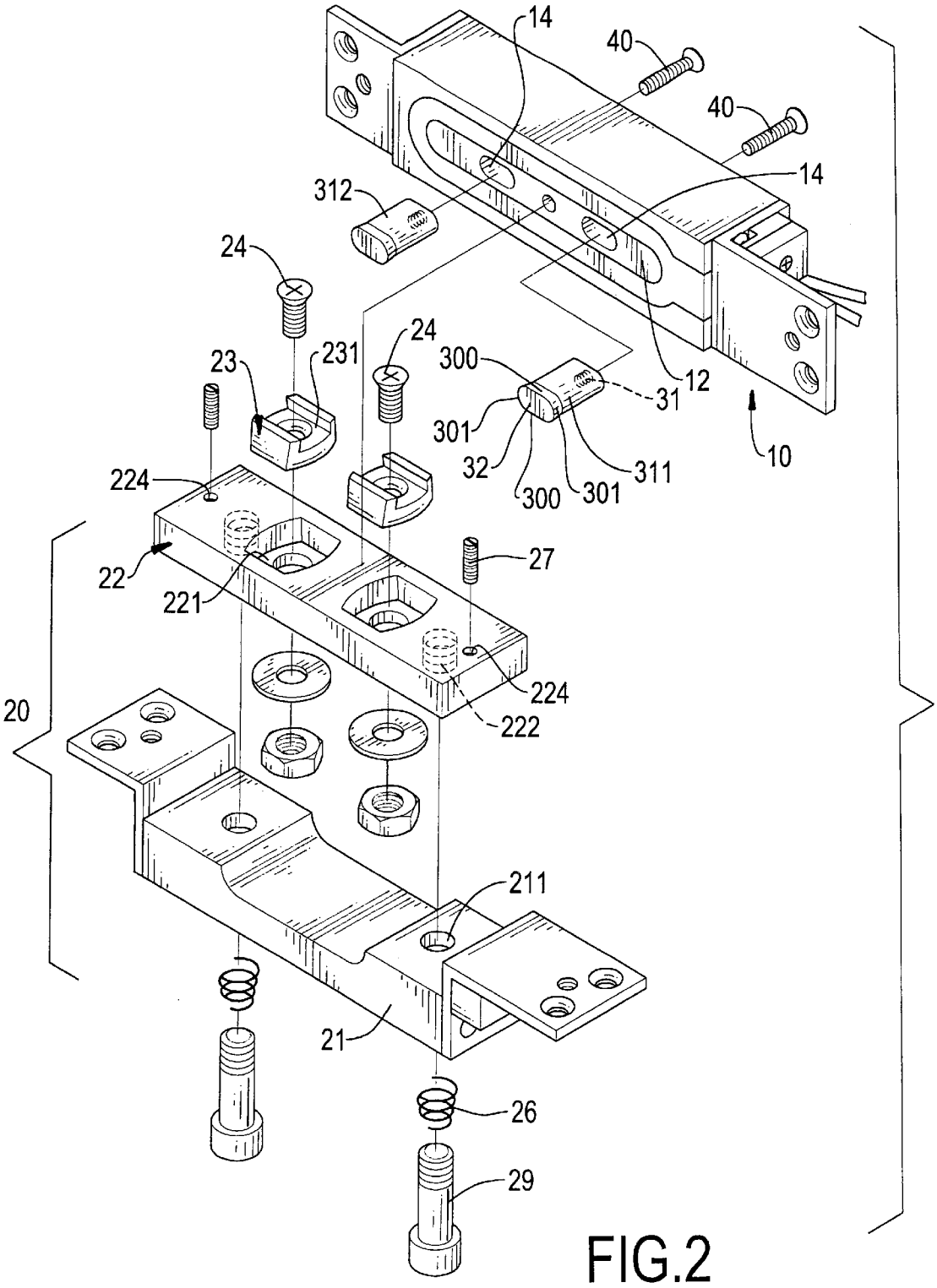
FIG. 2 is an exploded perspective view of the magnetic lock of the present invention.

With reference to FIGS. 1 and 2, the first base (10) has a first frame (11) with a first metal block (12) integrally formed in the first frame (11). The first metal block (12) has two through holes (14) to allow extension of two bolts (40) respectively extending into the two through holes (14). An electrical magnet (13) is mounted around the first metal block (12) so that after an electrical current is provided to the electrical magnet (13), a magnetic field is generated. A first bolt (311) and a second bolt (312) are provided to be respectively received in the two through holes (14) of the first metal block (12). Each of the first bolt (311) and the second bolt (312) has a threaded hole (31) defined to correspond to one of the bolts (40), and a head (32). The first bolt (311) and the second bolt (312) are elongated in shape and each of the first bolt (311) and the second bolt (312) has two plane abutting side faces (300) and two arcuate side faces (301) formed around the plane abutting side face (300). The head (32) has a truncated pyramidal shape in cross section.

The second base (20) has a second frame (21) and a second metal block (22) movably connected to the second frame (21).

The second frame (21) has two apertures (211) defined to correspond to two retainers (29) such as bolts. The second metal block (22) has two retaining recesses (221) and two retaining holes (222) corresponding to the two retainers (29). Two adjusting holes (224) are respectively formed on opposite sides of the second metal block (22) so that two adjusting bolts (27) are able to be screwingly inserted into the two adjusting holes (224) respectively to abut a face of the second frame (21). Two springs (26) are provided below the second frame (21) and are respectively mounted around the two retainers (29). Thus, when the two retainers (29) are threadingly inserted into the two retaining holes (222) with the two springs (26) respectively received in the apertures (211) and respectively mounted on the two retainers (29), the second metal block (22) is movable with respect to the second frame (21).

Two clamping blocks (23) are provided to respectively correspond to the two retaining recesses (221). Each of the two clamping blocks (23) has a truncated pyramidal recess (231) defined inside the clamping block (23) to correspond to the truncated pyramidal heads (32) of the first bolt (311) and the second bolt (312). It is to be noted that a width of the truncated pyramidal recess (231) is twice a width of the truncated pyramidal head (32). A bolt and nut combination (24) is thus able to secure the two clamping blocks (23) on the second metal block (22). In order to enhance the adaptability of the clamping blocks (23), the two clamping blocks (23) are movable relative to the second metal block (22) after the bolt and nut combination (24) is applied.

Figure 4:
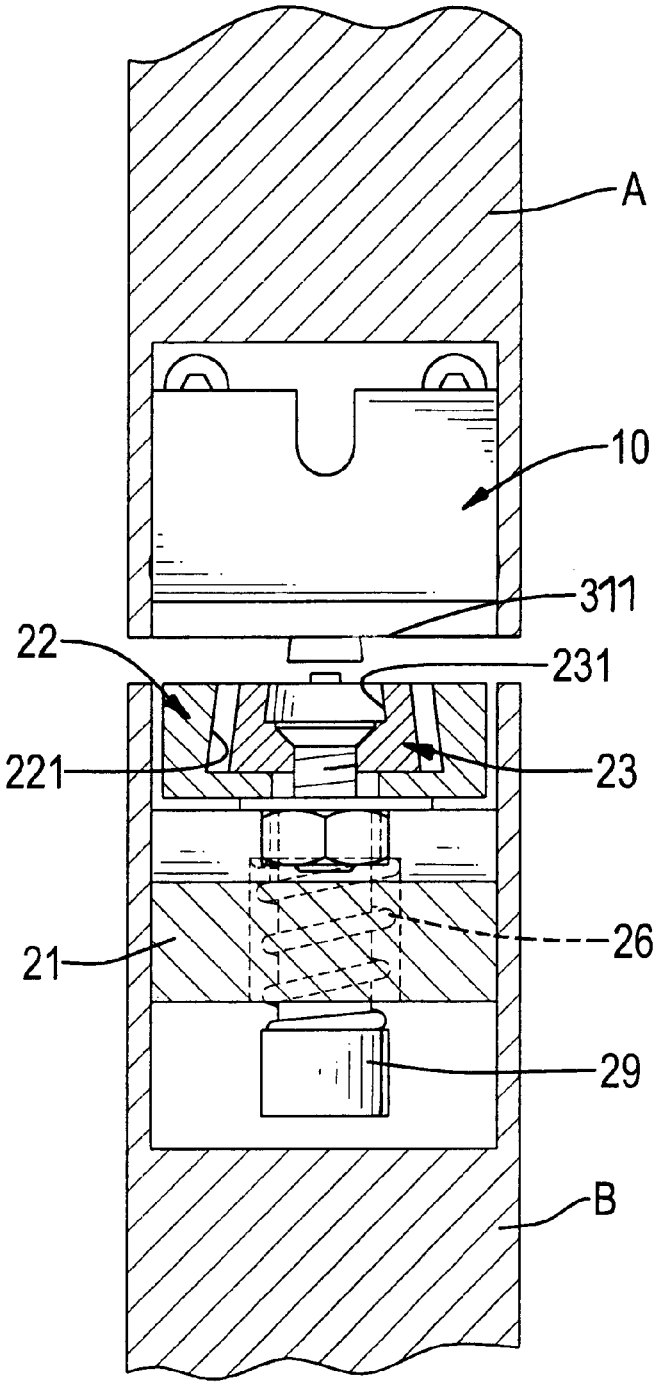
FIG. 4 is a schematic view with partial in cross section to show the relative position between the bolt and the clamping block.
Figure 6:
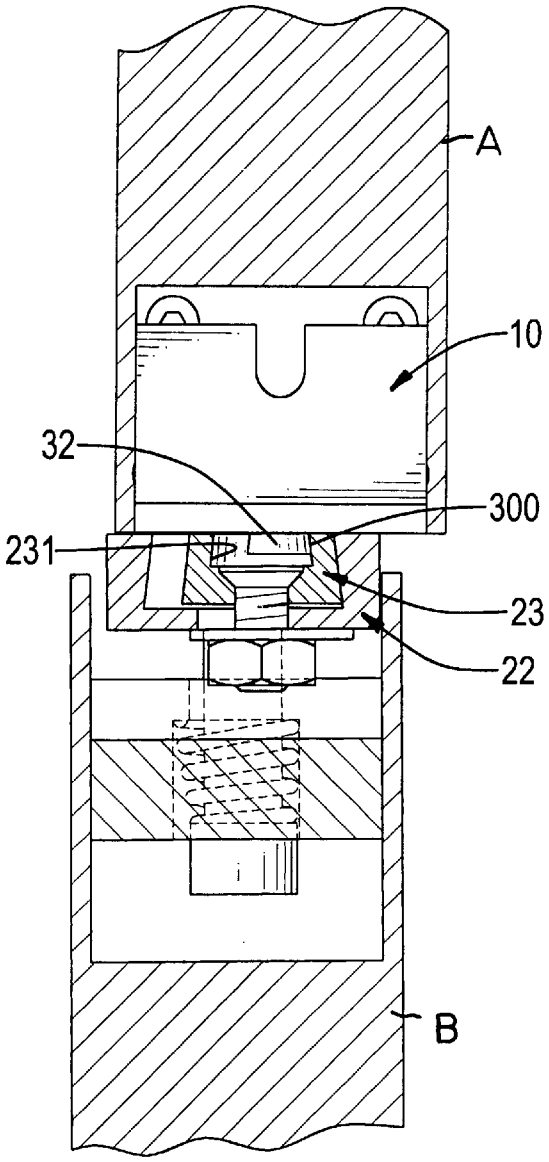
FIG. 6 is a schematic view showing that if an external force is applied to the door when the door is locked to the doorframe, the abutment of the bolt to a side face of the retaining recess secures the door in a locked position.

With reference to FIGS. 3 and 4, when the magnetic block of the present invention is assembled, the first bolt (311) and the second bolt (312) are securely mounted on the first metal block (12) to correspond to the truncated pyramidal recesses (231) of the two clamping blocks (23).

Figure 5:
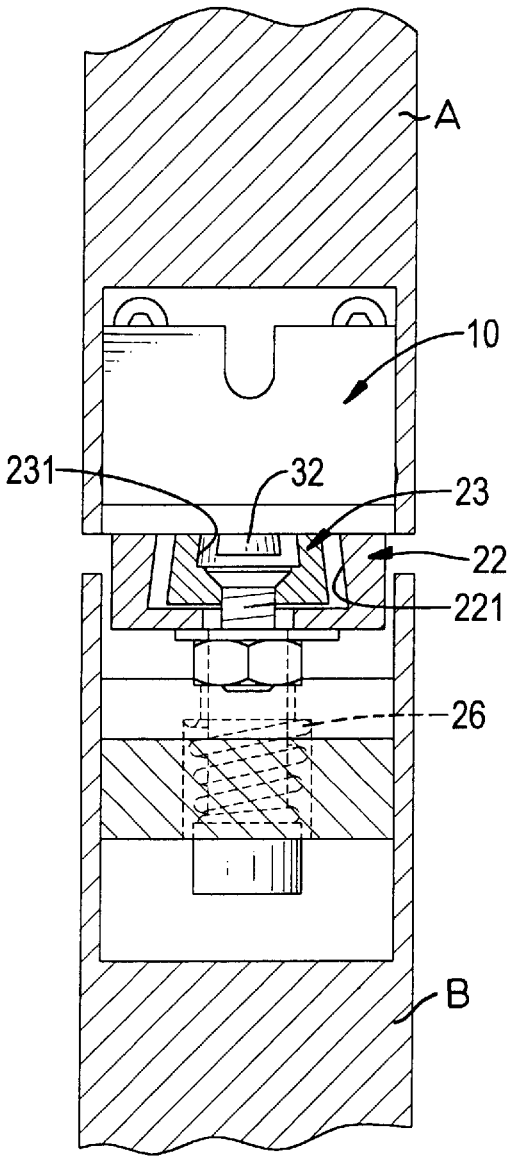
FIG. 5 is a schematic view showing that the bolt is received in the corresponding retaining recess in the clamping block.
Figure 7:
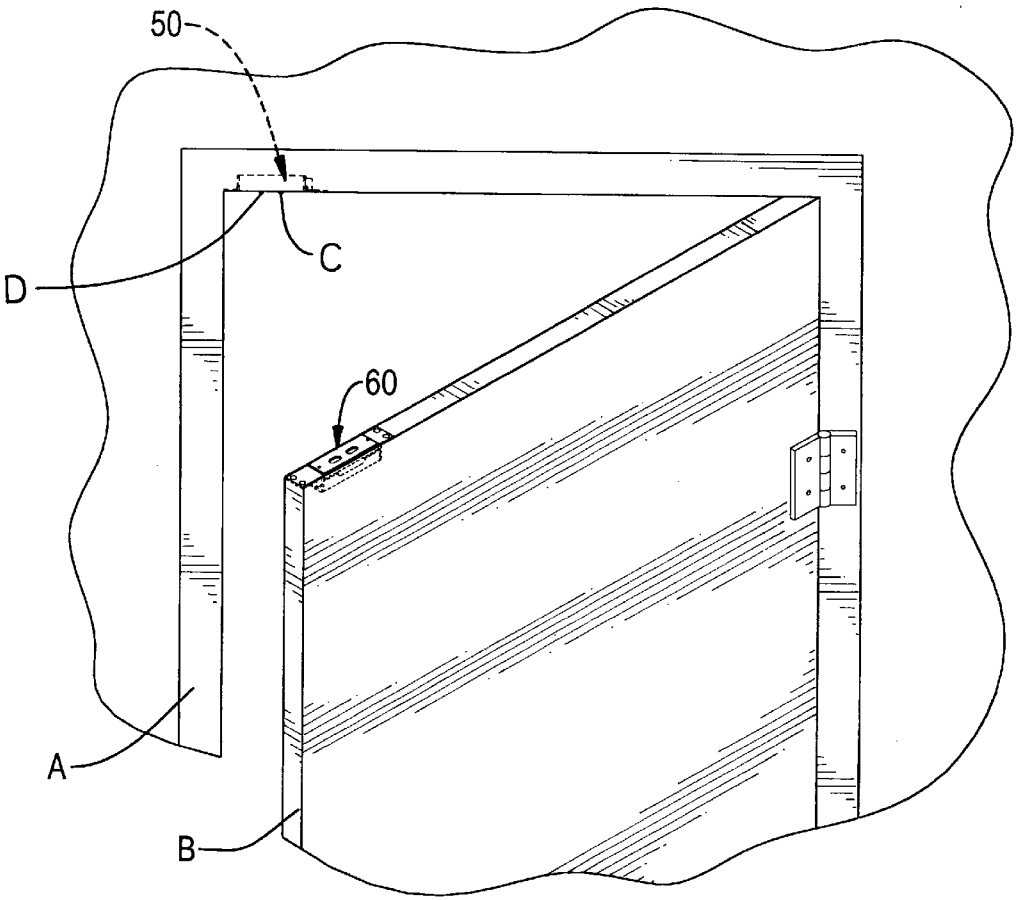
FIG.7 PRIOR ART
FIG. 7 is a schematic view showing a relative position of a first base to a second base of a conventional magnetic lock.
Figure 8:
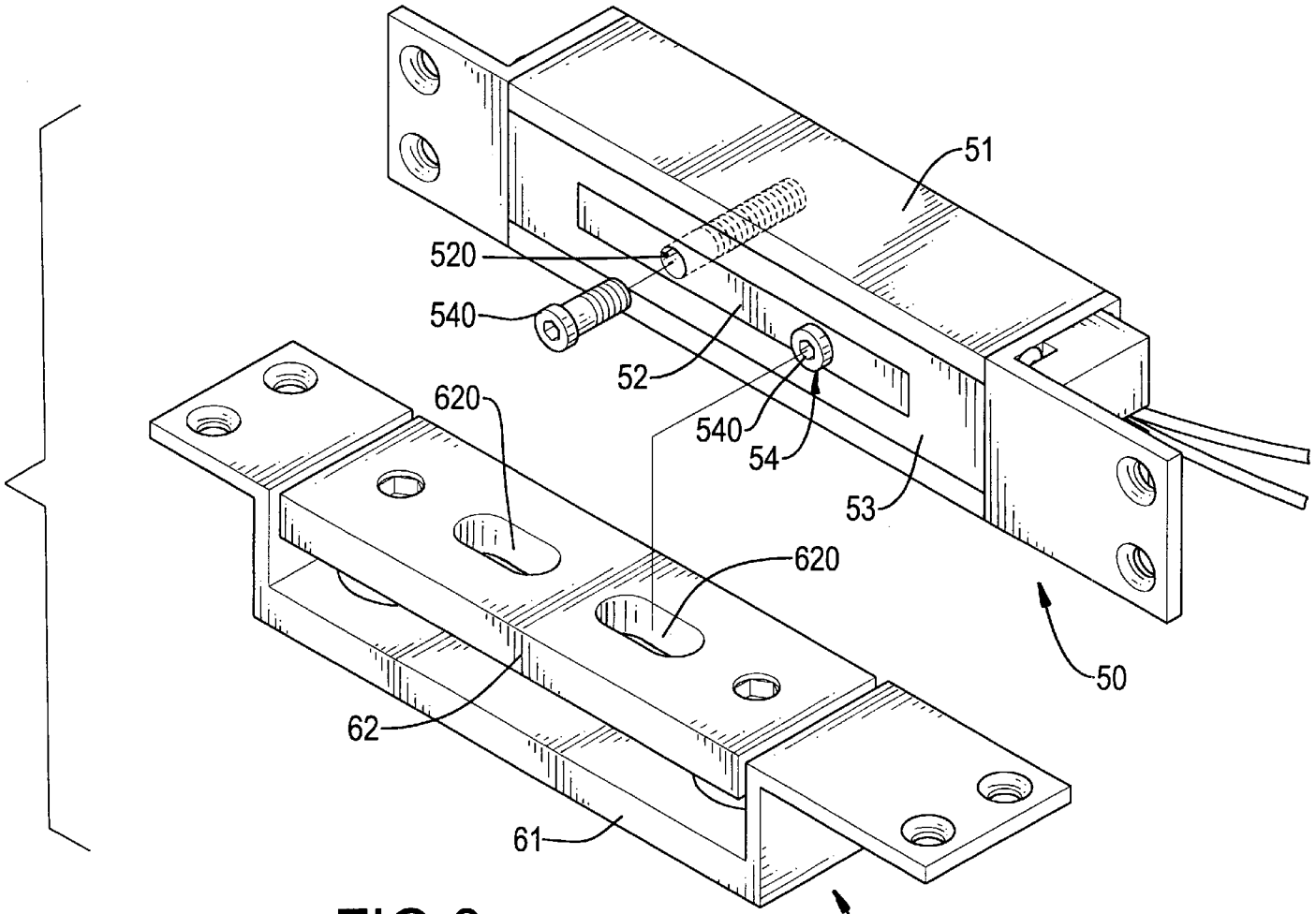
FIG.8 PRIOR ART
FIG. 8 is a perspective view of the conventional view of the first base and the second base in FIG. 7.
Figure 9:
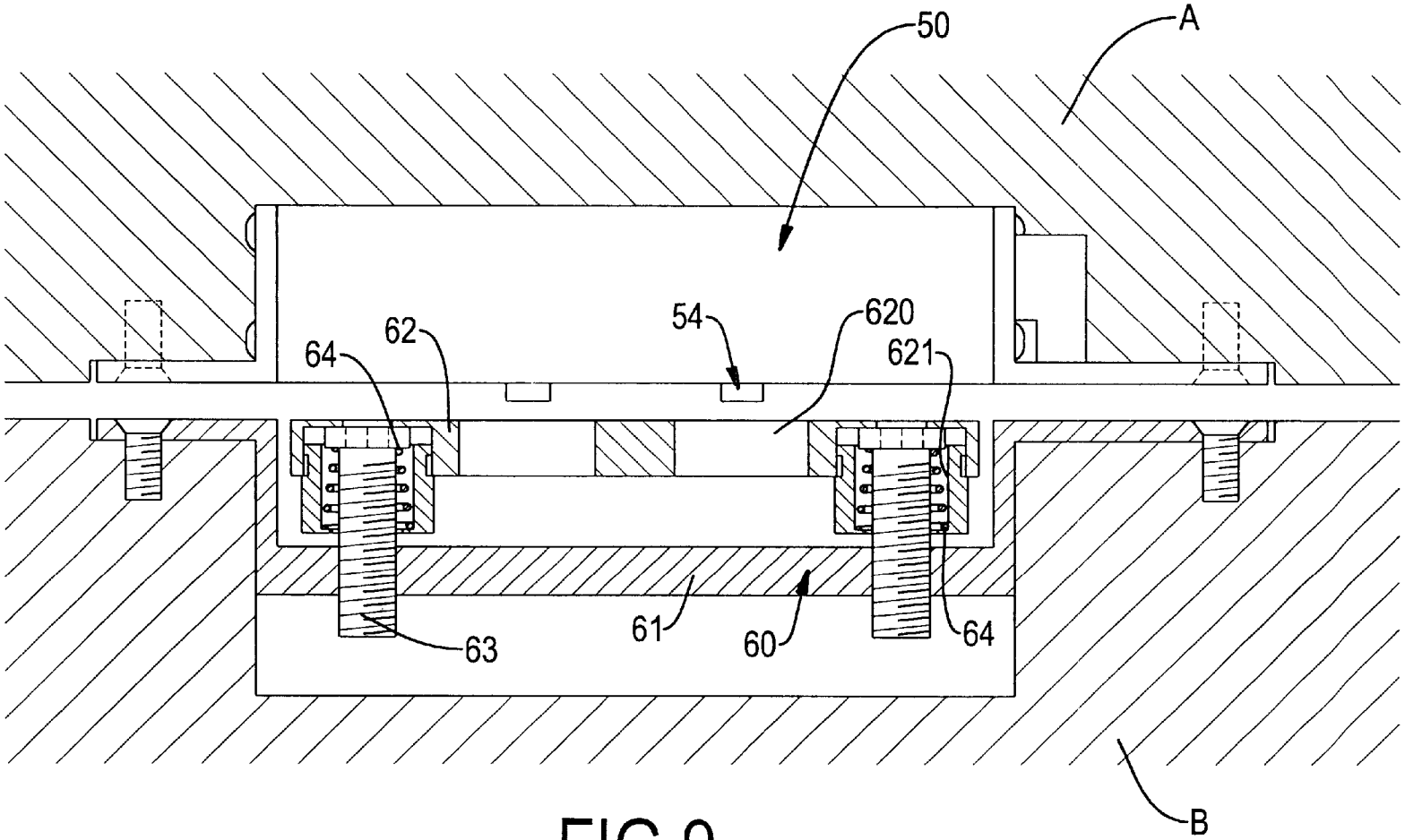
FIG.9 PRIOR ART
FIG. 9 is a cross sectioned side view showing the assembled magnetic lock in FIG. 7.
Figure 11:
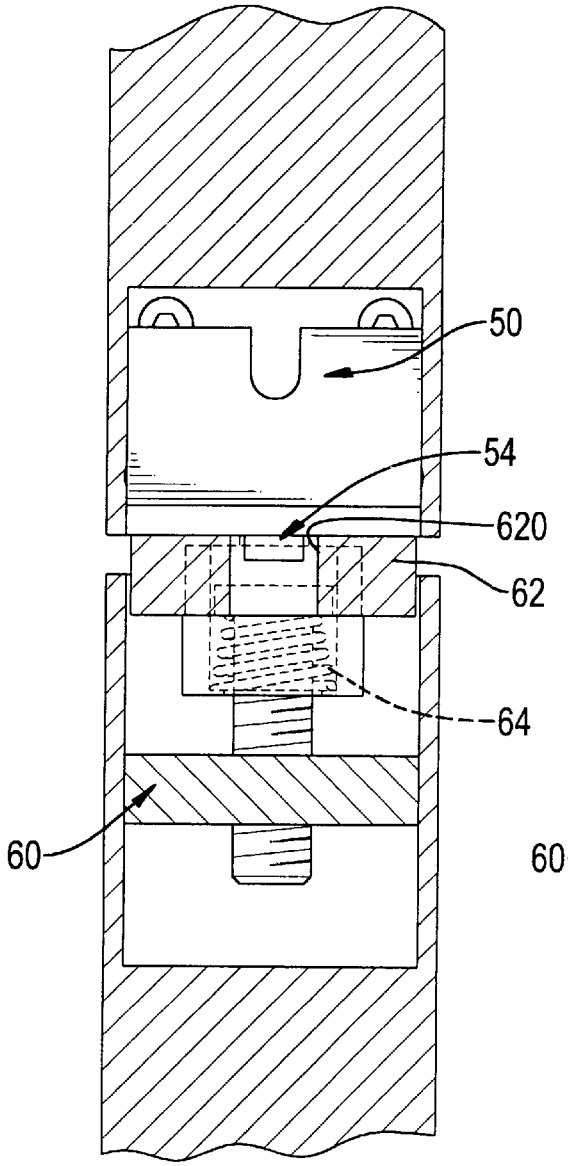
FIG.11 PRIOR ART
FIG. 11 is a schematic view showing that the head is received in the corresponding retaining recess in the second frame.
Figure 10:
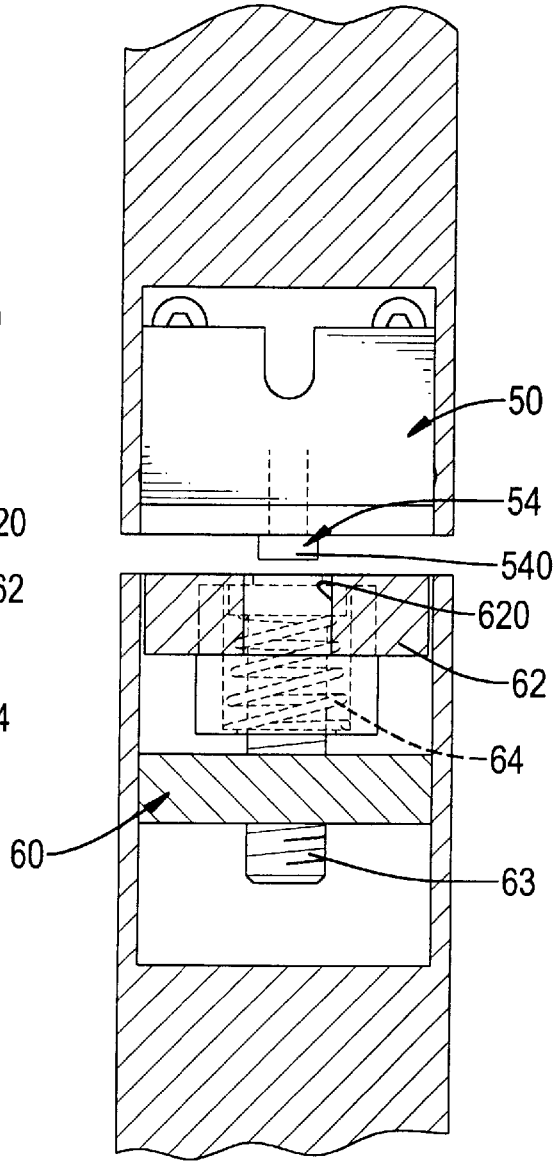
FIG.10 PRIOR ART
FIG. 10 is a schematic view showing the head is ready to be received in the corresponding retaining recess in the second frame.
Figure 12:
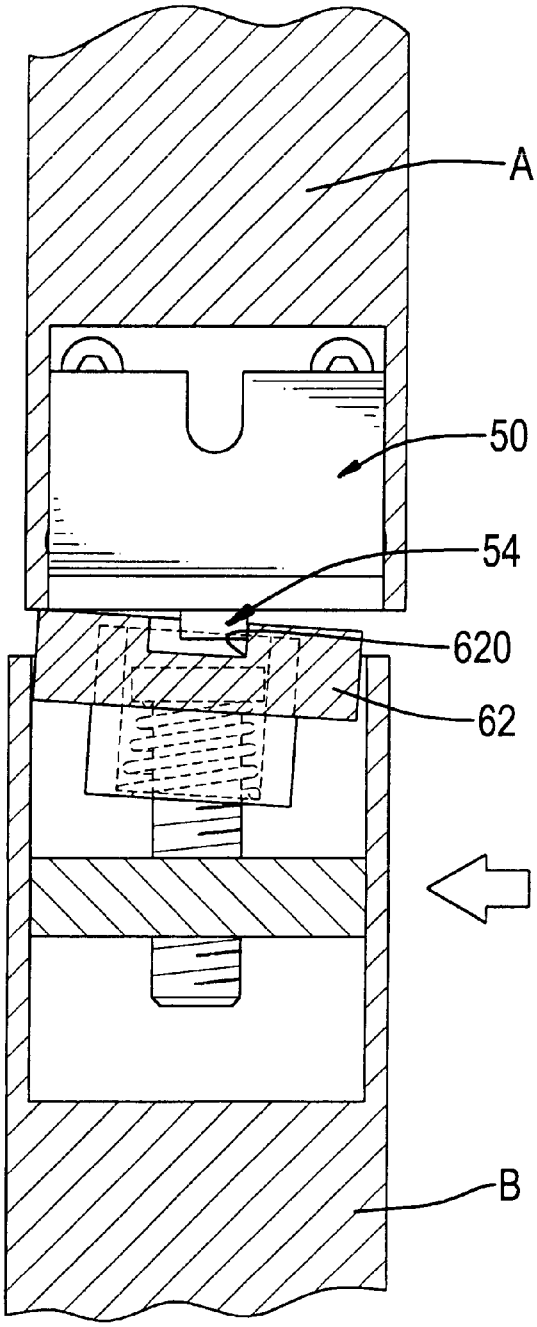
FIG.12 PRIOR ART
FIG. 12 is a schematic view showing that forcing to open the door while the door is locked will cause the second metal block to tilt.

With reference to FIG. 5 and still taking FIGS. 1 and 2 for reference, when the electrical magnet (13) is energized to induce the first metal block (12) to become a magnet as well, the second metal block (22) is attracted to move toward the first metal block (12). Thus, the first bolt (311) and the second bolt (312) are respectively received in the truncated pyramidal recesses (231) in the two clamping blocks (23). When the second metal block (22) is moving upward to the first metal block (12), the two springs (26) are compressed to store a recovery force for the second metal block (22) to move away from the first metal block (12) when the electrical current is off. However, when the magnetic field is still on and the door (B) is locked to the doorframe (A), pushing the door (B) will cause a displacement of the clamping blocks (23) to allow an inner side face of each of the truncated pyramidal recesses (231) to abut the abutting side face (300) of each of the truncated pyramidal heads (32) in the same time. Thus, the abutment between the inner side face of each of the truncated pyramidal recesses (231) and the abutting side face (300) of each of the truncated pyramidal heads (32) still secures the door (B) without causing the second metal block (22) to tilt. Thus, even if the door (B) is pushed violently, because of the mutual relationship between the truncated pyramidal heads (32) and the truncated pyramidal recesses (231), the door (B) is still secured to the doorframe (A).

The adjusting bolt (27) can be used to adjust the gap between the first base (10) and the second base (20) when first installation of the magnetic door lock to offset the variations between different models of the frame and the door.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a magnetic lock having a first frame adapted to be mounted on a doorframe and provided with a first metal block integrally formed in the first frame, the first metal block having two through holes to securely receive therein two bolts, and an electrical magnet adapted to connect to a power source to selectively become a magnet and a second frame adapted to be mounted on a door and provided with a second metal block movable with respect to the first metal block and the second frame, the second metal block having two retaining recesses to respectively receive therein two clamping blocks, wherein the improvement comprises:

each of the two clamping blocks is adapted to be movably received in a respective one of the two retaining recesses and has a recess so defined to receive therein one of the two bolts, whereby when the second frame is moved to cause the second metal block to move accordingly, an inner side face of the recess of each of the clamping blocks correspondingly abuts a side face of each of the bolts so that the door is still secured to the doorframe.

2. The magnetic lock as claimed in claim 1, wherein the recess is a truncated pyramidal recess.

3. The magnetic lock as claimed in claim 2, wherein each of the bolts has a truncated pyramidal head to correspond to the truncated pyramidal recess of each of the clamping blocks.

4. The magnetic lock as claimed in claim 2, wherein the truncated pyramidal recess has a width two times larger than a width of the truncated pyramidal head.

5. The magnetic lock as claimed in claim 3, wherein the truncated pyramidal recess has a width two times larger than a width of the truncated pyramidal head.

6. The magnetic lock as claimed in claim 1, wherein two adjusting holes are respectively formed on opposite sides of the second metal block so that two adjusting bolts are able to be screwingly inserted into the two adjusting holes respectively to abut a face of the second frame such that a distance between the first metal block and the second metal block is adjustable.

7. The magnetic lock as claimed in claim 5, wherein two adjusting holes are respectively formed on opposite sides of the second metal block so that two adjusting bolts are able to be screwingly inserted into the two adjusting holes respectively to abut a face of the second frame such that a distance between the first metal block and the second metal block is adjustable.

8. The magnetic lock as claimed in claim 1, wherein two springs are provided below the second frame to be respectively received in an aperture in the second frame and are respectively mounted around the two retainers, so that when the two retainers are threadingly inserted into the two retaining holes with the two springs received in the two apertures of the second frame and respectively mounted on the two retainers, the second metal block is movable with respect to the second frame.

9. The magnetic lock as claimed in claim 5, wherein two springs are provided below the second frame to be respectively received in an aperture in the second frame and are respectively mounted around the two retainers, so that when the two retainers are threadingly inserted into the two retaining holes with the two springs received in the two apertures of the second frame and respectively mounted on the two retainers, the second metal block is movable with respect to the second frame.

10. The magnetic lock as claimed in claim 6, wherein two springs are provided below the second frame to be respectively received in an aperture in the second frame and are respectively mounted around the two retainers, so that when the two retainers are threadingly inserted into the two retaining holes with the two springs received in the two apertures of the second frame and respectively mounted on the two retainers, the second metal block is movable with respect to the second frame.

11. The magnetic lock as claimed in claim 7, wherein two springs are provided below the second frame to be respectively received in an aperture in the second frame and are respectively mounted around the two retainers, so that when the two retainers are threadingly inserted into the two retaining holes with the two springs received in the two apertures of the second frame and respectively mounted on the two retainers, the second metal block is movable with respect to the second frame.

* * * * *